US007165429B2

(12) United States Patent
Steingroever

(10) Patent No.: US 7,165,429 B2
(45) Date of Patent: Jan. 23, 2007

(54) DEVICE FOR AND METHOD OF ELECTROMAGNETIC HIGH ENERGY PULSE DEFORMATION OF WORKPIECES, IN PARTICULAR METAL SHEETS OF ELECTRICALLY CONDUCTIVE MATERIAL

(75) Inventor: Dietrich Steingroever, Bergisch Gladbach (DE)

(73) Assignee: Magnet-Physik Dr. Steingroever GmbH, Cologne (DE)

( * ) Notice: Subject to any disclaimer, the term of this patent is extended or adjusted under 35 U.S.C. 154(b) by 399 days.

(21) Appl. No.: 10/879,865

(22) Filed: Jun. 29, 2004

(65) Prior Publication Data

US 2005/0034497 A1 Feb. 17, 2005

(30) Foreign Application Priority Data

Aug. 14, 2003 (DE) ..... 103 37 769

(51) Int. Cl.
*B21D 26/14* (2006.01)

(52) U.S. Cl. ..... 72/56; 72/707; 29/419.2

(58) Field of Classification Search ..... 72/54, 72/55, 56, 705, 706, 707; 29/419.2
See application file for complete search history.

(56) References Cited

U.S. PATENT DOCUMENTS 3,115,857 A * 12/1963 Pfanner ..... 72/56
3,175,383 A * 3/1965 Levine ..... 29/599
3,581,540 A * 6/1971 Wildi ..... 72/56
5,684,341 A 11/1997 Steingroever
5,860,306 A * 1/1999 Daehn et al. ..... 72/56
6,227,023 B1 5/2001 Daehn et al.
6,564,605 B1 5/2003 Gafri et al.
6,708,542 B1 * 3/2004 Gafri et al. ..... 72/56

FOREIGN PATENT DOCUMENTS

DE 146 403 10/1979
DE 146 403 2/1981
DE 44 23 992 A1 2/1995
DE 44 23 992 C2 9/1995

* cited by examiner

*Primary Examiner*—Dmitry Suhol
(74) *Attorney, Agent, or Firm*—Michael J. Striker

(57) ABSTRACT

A device for electromagnetic high energy pulse deformation of workpieces of an electrically conductive material has a deformation tool including a coil carrier and at least two partial coils arranged on the coil carrier, at least one surge current generator to which the partial coils are connected so that magnetic fields of the partial coils superpose to form a resulting magnetic field which acts on the workpiece, the partial coils being formed as spiral coils which are formed identically with respect to inductivity, electrical resistance, winding number and forming, and each of the partial coils extending on the coil carrier from an inner starting point in an identical form and with a corresponding identical distance to a neighboring one of the partial coils in a spiral-shaped manner outwardly; and a method of electromagnetic high energy pulse deformation is proposed as well.

26 Claims, 4 Drawing Sheets

DEVICE FOR AND METHOD OF ELECTROMAGNETIC HIGH ENERGY PULSE DEFORMATION OF WORKPIECES, IN PARTICULAR METAL SHEETS OF ELECTRICALLY CONDUCTIVE MATERIAL

BACKGROUND OF THE INVENTION

The present invention relates to a device for electromagnetic high energy pulse deformation of workpieces, in particular metal sheets, from an electrically conductive material, as well as to a method of electromagnetic high energy pulse deformation of workpieces.

Patent document DD 146 403 discloses a device for electromagnetic high energy pulse deformation, which is composed of a magnetic deformation coil as a deformation tool and "n" surge current generators. A device for electromagnetic high energy pulse deformation must be provided so that its application region is expanded with respect to the known devices without additional circuit and device-technical expenses. The device must be designed so that with a simple means, high storage energies can be obtained without reduction of the frequency of the discharge current.

In the known device it is achieved in that in the deformation tool of the device is composed of several partial coils, wherein each partial coil has only a few windings, in an extreme case only one winding, and is connected, potential-separately from the other partial coils, to a respective surge current generator which is ignitable simultaneously together with other surge current generators. The individual partial coils are assembled mechanically so that the magnetic fields of the individual partial coils are superimposed to provide a resulting magnetic field which acts on the workpiece. This is advantageous in that the delays of the partial streams of the individual surge current generators occurring by the different scattering times of the switching means are of secondary importance because of the sufficiently great current-delayed action of the inductivities of the partial coils. The discharge frequencies of the individual surge current circuits must be brought easily to superposition by the selection of the conductor lengths between the surge current generator and the corresponding partial coil of the deformation tool. With the use of a deformation tool assembled from a plurality of partial coils with low winding numbers and several surge current generators, it is possible to realize very high discharge frequencies and very high magnetic field intensities which act on the workpiece to be deformed.

The known device is composed substantially of a deformation tool and four surge current generators, wherein the deformation tool can be formed as a compression coil assembled of four oppositely electrically insulated single-winding partial coils. Each of the four partial coils of the deformation tool is connected to a respective one of the surge current generators, so that four separate surge current circuits are provided.

Instead of the compression coil, also a flat coil can be composed of four single-winding partial coils. It is also recommended to use an expansion coil or any other coil formed with subdivided windings.

With the known embodiment including flat coils, the partial coils shown in the patent document DD 146 403 with different diameters are arranged concentrically relative to one another so that an inwardly arranged coil has a different diameter than an outwardly arranged coil. As a result, all partial coils have different resistances and inductivities which can be compensated by additional features, such as winding numbers or differently long connection cables. However, the connection and the energy supply of such flat coils is extremely complicated and requires an increase in switching expense, wherein simultaneous deformation of the workpieces to be machined must be performed.

SUMMARY OF THE INVENTION

Accordingly, it is an object of the present invention to provide a device in accordance with the above mentioned general type, which avoids the disadvantages of the prior art.

More particularly it is an object of the present invention to provide a device for an electromagnetic high energy pulse deformation of workpieces, which is developed in an especially simple manner as to its circuitry so that a homogenous symmetrical radial electronic field can be produced with a low switching expense. Also, a method for electromagnetic high energy pulse generation is proposed, which achieves the same results.

In keeping with these objects and with others which will become apparent hereinafter, one feature of the present invention resides, briefly stated, in a device for electromagnetic high energy pulse deformation of workpieces of an electrically conductive material, comprising a deformation tool including a coil carrier and at least two partial coils arranged on said coil carrier; at least one surge current generator to which said partial coils are connected so that magnetic fields of said partial coils superpose to form a resulting magnetic field which acts on the workpiece, said partial coils being formed as spiral coils which are formed identically with respect to inductivity, electrical resistance, winding number and shape, and each of said partial coils extending on said coil carrier from an inner starting point in an identical form and with a corresponding identical distance to a neighboring one of said partial coils in a spiral-shaped manner outwardly.

In accordance with the present invention, a method is proposed which comprises the steps of providing a deformation tool including a coil carrier and at least two partial coils arranged on said coil carrier; connecting said partial coils with at least one surge current generator so that magnetic fields of said individual partial coils superpose to produce a resulting magnetic field acting on the workpiece; forming said partial coils as spiral coils identically with respect to inductivity, electrical resistance, binding number and shape; extending each of said partial coils on said coil carrier from an inner starting point in an identical form and with an identical distance to a neighboring one of said partial coils in a spiral-shaped way outwardly.

Since in accordance with the present invention, the partial coils on the coil carrier are formed identically with respect to inductivity, electrical resistance, winding number and shape and each partial coil extends from its inner starting point in an identical shape and is guided with a same distance with respect to neighboring partial coils in a spiral-shaped manner, spiral-shaped partial coils connected with one another are produced with smaller inductivity and a substantially smaller electrical resistance as in the case of conventional flat coils. In an especially simple manner, it is possible with small condensator voltages of for example 3,000 E or 3 kV to provide a high pulse current flow and thereby, with a low electrical expense, to produce high pulse fields. Capacitor voltages of for example 3 kV are located in a low voltage region and can be controlled with conventional surge current generators and conventional switching devices, such as for example conventional capacitors, diodes, thyristors and semiconductor components, as well as conventional isolation materials, without problems. Thereby an improved personal safety is guaranteed than with otherwise required high voltages for example 20–30 kV and more.

The flat coil assembled of identically formed spiral-shaped partial coils can have for example a splitting technique of 3×6 kV, or total 18 kV, and can be operated with an electromagnetic generator for fast current and magnetic field pulses as disclosed in DE 44 23 992 C2.

In addition to the illustrated spiral-shaped arrangement of the individual partial coils, they can also have a four, six or multi-part coil configuration, depending on the number and arrangement of the inner starting points on the coil carrier.

For producing a uniform magnetic field, the partial coils, depending on the used coil material and coil shape, can be arranged as tight as possible against one another. It is especially efficient when each partial coil has for example two full windings extending over each 360° C. The partial coils on the coil carrier can be easily electrical separated from one another or connected electrically with one another in the center of the coil carrier.

For producing a uniform magnetic field it is also advantageous when the inwardly located and/or the outwardly located terminals of "n" partial coils on the coil carrier over a corresponding number of "n" of the sectors of the same size are arranged so that they are offset by identical angular distances. The partial coils must be arranged with their windings on the coil carrier tightly near one another in corresponding identical distances. The partial coils can be arranged also with different or a changing, radially increasing or radially reducing, distance of the windings.

An especially precise formation of the partial coils can be obtained when the inner starting points of the individual partial coils and the outwardly located terminal points are located on connecting lines which extend as rays from the center of the coil carrier at correspondingly identical distances. All partial coils, depending on the demand and application, can be connected to a common surge current generator, or connected each with corresponding current individual supplies, that are individually programmable with respect to the voltage and the time of ignition.

In accordance with another embodiment of the present invention, the partial coils in a known manner can be wound from conductors with a round cross-section. The partial coils can be formed on the coil carrier also as flat coils with a rectangular conductor cross-section. This is especially advantageous from the manufacturing point of view, since the partial coils then are cut from a single metal sheet blank and can be mounted as a finished mounting unit on the coil carrier.

Depending on the application, it can be advantageous when the partial coils on the coil carrier are provided with a conical or a funnel-shaped profile. For a possible easy deformation of the metal sheet blanks processed with the device, it is especially advantageous when the matrix in the matrix receptacle of the shaping tool opposite to the coil arrangement is surrounded by ventilation chambers, in which air trapped during the forming process between the tool or the metal plate and the matrix hollow space can be escaped. The produced workpiece can be thereby made without conventional post processing in a single manufacturing step, so that the matrix, on its outer periphery and at locations at which hole-shaped punch-outs or openings must be produced on the workpiece or the metal sheet, are formed sharp-edged as a separating tool and/or are provided with cutting and/or deforming edges or corrugations or webs.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
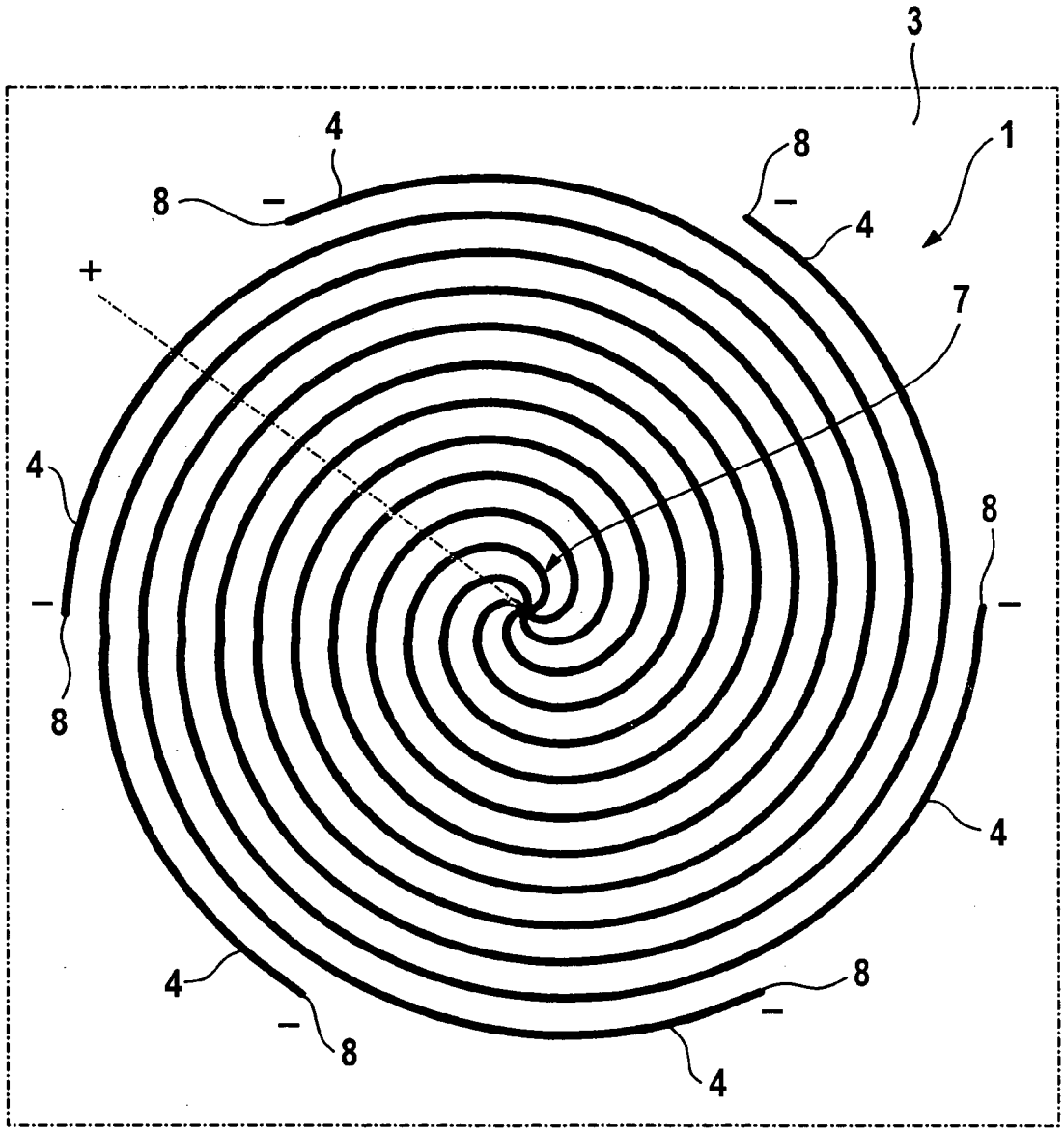
FIG. 1 is a view showing a coil configuration composed of six identical spiral-shaped partial coils, whose course is shown in form of central lines of a conductor and which are connected with one another electrically in a coil central point and also are connected at outwardly located connection points with a corresponding number of current supplies in form of surge current generators.

FIGS. 1–5 show two different embodiments of devices 1 for electromagnetic high energy pulse deformation of workpieces, in particular metal sheets, of an electrically conductive material. The device has a deformation tool 2 shown in FIGS. 4 and 5, which is composed of a coil carrier 3 and at least two partial coils 4 shown in FIGS. 1, 2, 3, which are arranged on the coil carrier 3 and connected with at least one surge current generator 5. The magnetic fields of the individual partial coils 4 thereby superposed to form a resulting magnetic field that acts on the workpiece 6.

All partial coils 4 on the coil carrier 3 are spiral coils and are formed completely identically with respect to inductivity, electrical resistance, winding number and shape. They are separated from one another by a thin insulation layer 4*a* shown in FIGS. 2, 3 and identified by a hatching between two partial coils 4.

Figure 2:
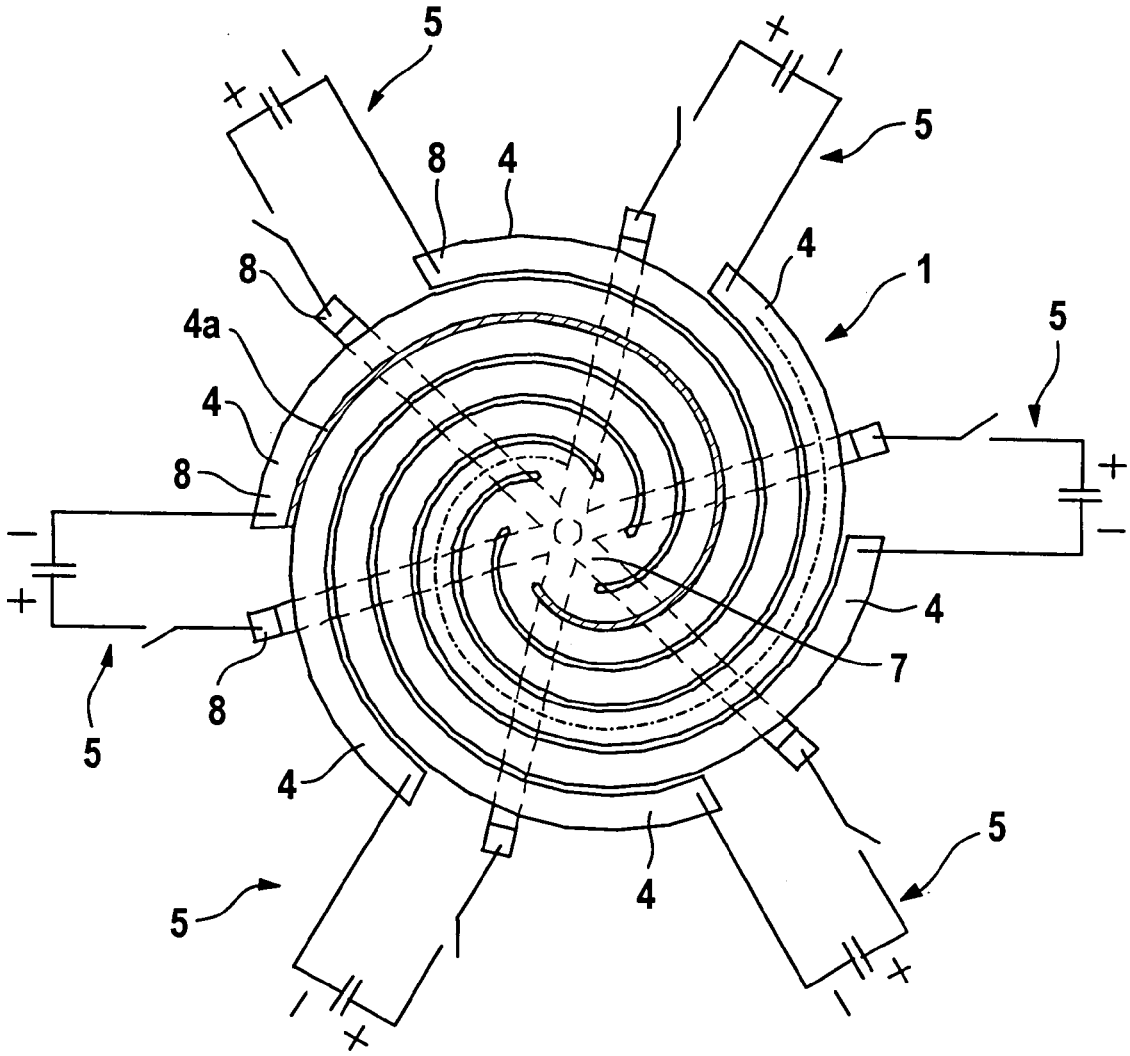
FIG. 2 is a view showing a further coil configuration of six spiral-shaped partial coils, wherein the conductor is illustrated and which are separated from one another by a thin isolation layer, and for a better observation with a small number of flat windings, wherein the individual partial coils also, as the partial coils of FIG. 1, are connected to several surge current generators.
Figure 3:
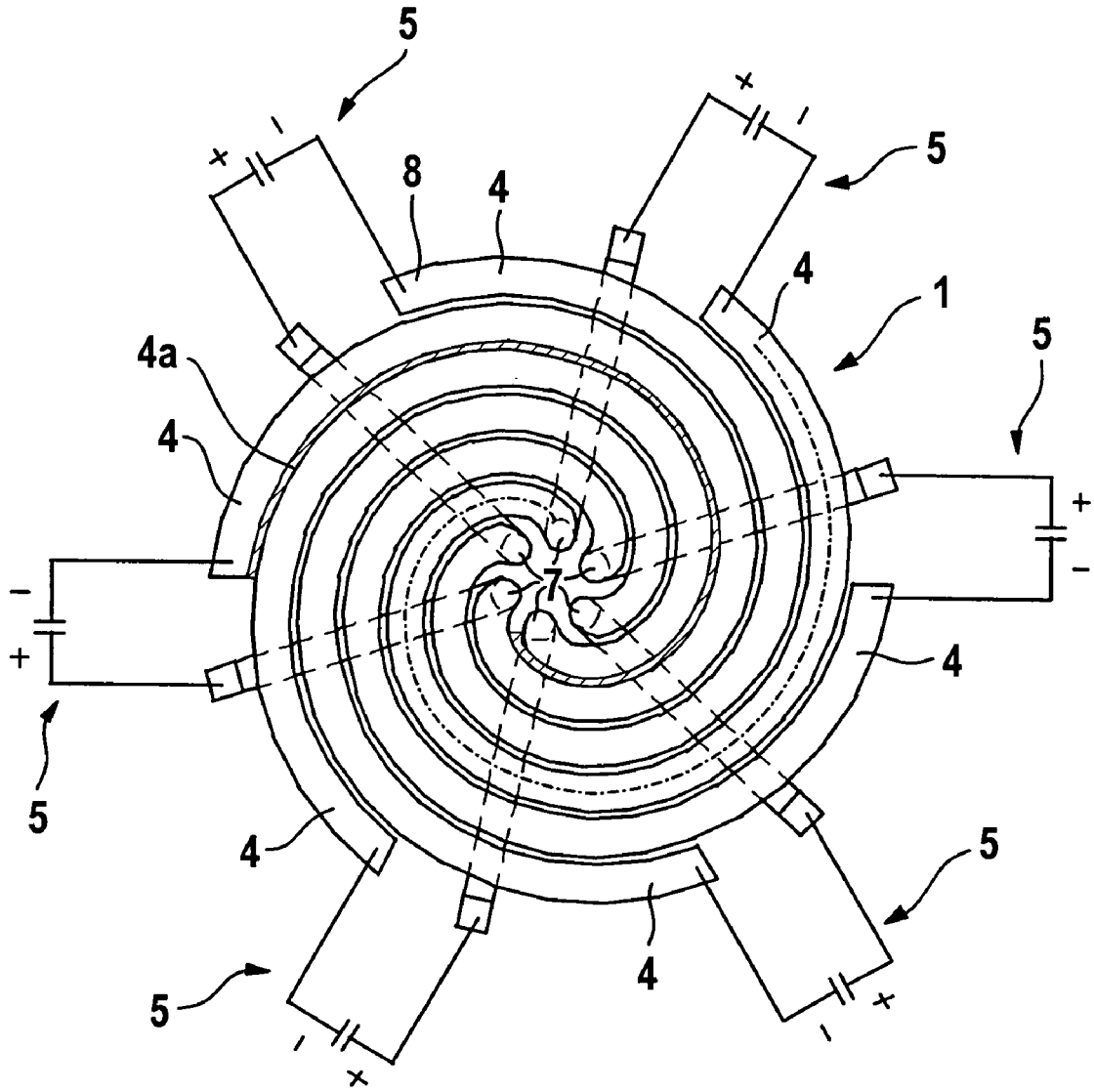
FIG. 3 is a view showing a coil configuration which is different from those shown in FIGS. 1 and 2, wherein the individual partial coils are electrically separated from one another, and each partial coil extends from an inner starting point at a corresponding identical radial distance from a center of the coil carrier.

Each separate coil extends from a center of the coil carrier 3 or at a same radial distance from it in the inner starting point 7, in an identical form and at an identical distance from the neighboring coils 4 in a spiral shaped fashion. Moreover, each partial coil 4 in the preferable embodiment has at least two full windings over each 360°, as shown in FIG. 1. In FIGS. 2 and 3 the partial coils 4, for improved observation, are shown with less windings, which however does not correspond to the practice.

As further shown in FIGS. 1 and 2, the partial coils 4 can be electrically connected with one another in the center of the coil carrier 3. This provides an especially stabile coil configuration against mechanical loads, in particular when the partial coils 4 are composed of a mechanically rigid, electrically highly conductive material. Such a material can be for example copper or an especially strong alloy of copper, chromium or zirconium, or the like.

The partial coils 4, when needed, can be arranged electrically separately from one another on the coil carrier 3, as shown in FIG. 3. The conductors or windings of the individual spiral-shaped identical partial coils 4 extend also from an inner starting point 7. The individual starting points can be however arranged at a small but identical radial distance in the ring-shaped fashion around the center of the not shown coil carrier 3 in FIGS. 1–3.

As can be further seen from FIGS. 1–3, in the both embodiments the inwardly located and/or the outwardly located connections 8 of "n" partial coils 4 on the coil carrier 3 are arranged offset over a corresponding number of "n" equally great sectors at the same angular distances of each 60°. This provides the conditions for an objectionable association of the individual partial coils 4 with respect to the corresponding current supplies 5.

The partial coils 4 in both embodiments are arranged with their windings at the same distances of the coil carrier 3 tightly near one another. They can be however arranged with a different or a changing, for example radially increasing or decreasing, distance between the windings.

Preferably, the inner starting point 7 of the individual partial coils 4 and the outwardly located connecting points 8 are located on imaginary lines which extend as rays from the center of the coil carrier 3 at equal distances.

All partial coils 4 can be connected however with one common surge current generator 5, without taking special features for dimensioning of the connecting conductors. An adaptation to special shapes can be performed in that the partial coils are connected with different current supplies 5 which are programmable individually with respect to the voltage and time point for ignition and thereby allow a simultaneous loading of the individual partial coils in a simple manner.

In the shown embodiments of FIGS. 2 and 3, the partial coils 4 are formed on the coil carrier 3 as flat coils. The partial coils 4 can be however formed with a conical profile, and the conductors of the individual partial coils can have a round or rectangular cross-section. In the latter case, it is possible to cut the partial coils 4 especially well from a single metal sheet blank and to cast on a coil carrier 3 by a suitable insulating material.

Figure 4:
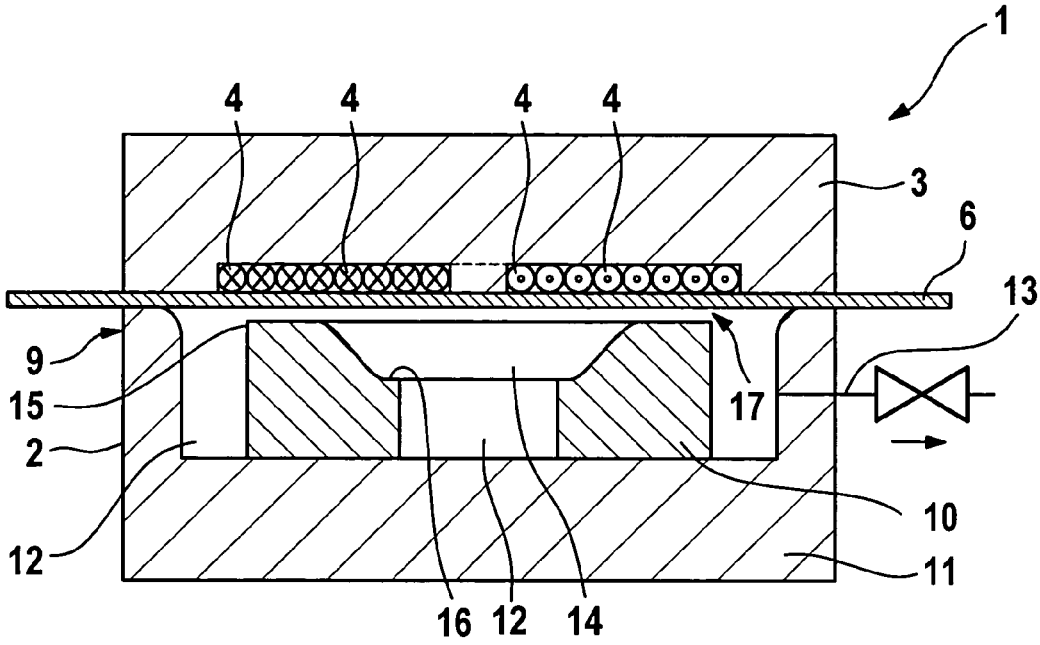
FIG. 4 is a view schematically showing a section through a forming tool for forming workpieces or metal sheets with a coil configuration of FIGS. 1, 2, or 3, in a closed condition of the forming tool before the process of forming.
Figure 5:
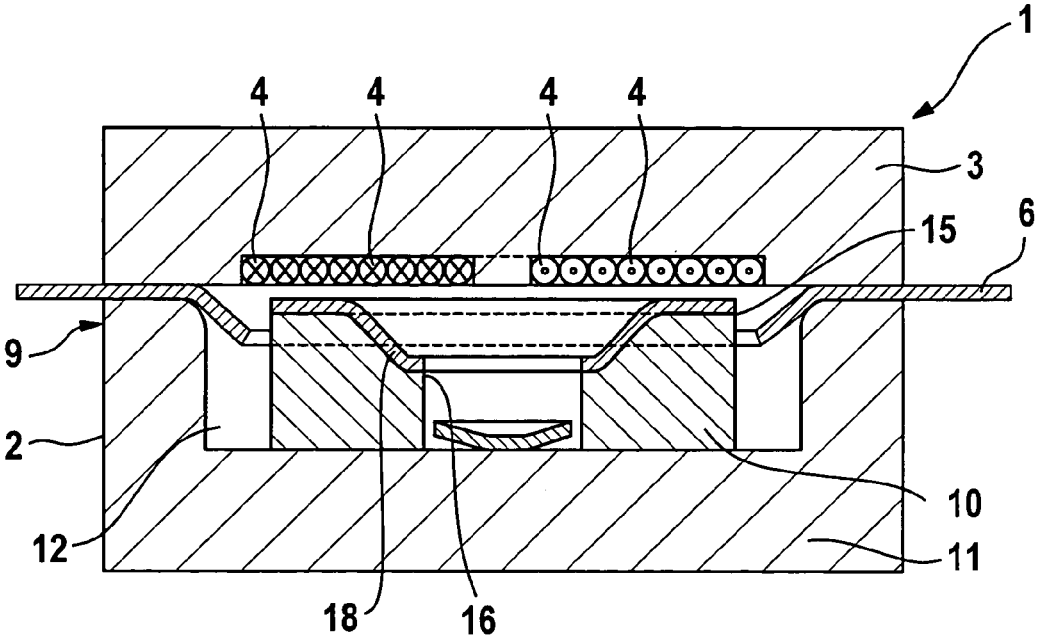
FIG. 5 is a view showing a section through the forming tool of FIG. 4 after the forming of the workpiece or metal sheet.

As shown in the cross-sections in FIGS. 4 and 5, a matrix 10 in the matrix receptacle 11 of a forming tool 9 is surrounded by ventilation chambers 12 with a vacuum connection 13, in which the air trapped during the forming process between the workpiece 6 or the metal plate and the matrix hollow space 14 can be discharged. Moreover, the matrix 10 is formed sharp-edged as a separating tool on its outer periphery 15 and on further locations 16, at which the hole-shaped punchouts or openings must be produced on the workpiece 6 or the metal sheet. For this purpose also suitable cutting and/or deforming edges or corrugations or webs can be introduced into the matrix 10.

It is thereby possible to separate the parts of the workpiece 6 or the metal sheet during striking on the matrix 10 in FIG. 5 and/or forming in the form hollow space 14 of the matrix by the sharp-edge regions both on the outer periphery 15 and also in the inwardly located region of the form hollow space 14, so that after the forming process the desired finished product can be discharged from the deforming tool.

During the process for electromagnetic high energy pulse deformation of the workpieces 6, in particular metal sheets, of a conductive material, with a deformation tool 2 in accordance with the above presented description, all partial coils 4 are loaded with the surge current generators 5 simultaneously or synchronously so that the current maxima of all partial coils 4 are set simultaneously.

This is obtained in that, all partial coils 4 are loaded with a common surge current generator 5. The partial coils 4 can be loaded also each by individual current supplies 5, which are programmable individually with respect to the voltage and the time of ignition.

During deformation of the workpiece 6 or the metal sheet it is possible, by corresponding electronic control of the surge current generators 5, to provide with increasing discharge first a small, and then a higher pressure, so that first the air which is enclosed during the forming between the workpiece 6 or the metal sheet and the matrix hollow space 14 can be discharged and the workpiece 6 or the metal sheet subsequently assumes the design of the matrix 10.

The control can be, for example, performed so that during fast deformation the air enclosed between the workpiece and the metal sheet and the matrix hollow space 14 can be guided out by controlled radially outwardly oriented force action of the magnetic field toward the outer edge of the matrix 10. A vacuum can be produced in the hollow space 14 of the matrix 10 moreover during the deformation of the workpiece 6 or the metal sheet, to exclude the buildup of an undesired counterpressure of the form hollow space 14.

Finally, especially advantageous manufacturing results are obtained when the workpiece 6 or the metal sheet are clamped on its outer periphery 15 between the coil carrier 3 and the matrix receptacle 11 or a pressing element in the functional plane of the work-or flat coil in an axial distance 17 from the matrix 10, so that during the forming process by the action of the magnetic field it is hurled first against the outer periphery of the matrix 10 and subsequently formed in the deform hollow space 14 of the matrix.

Moreover, the matrix 10 can be formed so that the parts of the workpiece 6 or the metal sheet during striking on the matrix 10 and/or during forming in the form hollow space 14 of the matrix are separated by the sharp-edged edge regions on the outer periphery 15 or in the inwardly located region of the form hollow space 14, so that after the forming process the desired finished product 18 can be discharged from the deformation tool 2.

It will be understood that each of the elements described above, or two or more together, may also find a useful application in other types of methods and constructions differing from the types described above.

While the invention has been illustrated and described as embodied in device for and method of electromagnet high energy pulse deformation of workpieces, in particular metal plates of electrically conductive material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A device for electromagnetic high energy pulse deformation of workpieces of an electrically conductive material, comprising a deformation tool including a coil carrier and at least two partial coils arranged on said coil carrier; at least one surge current generator to which said partial coils are connected so that magnetic fields of said partial coils superpose to form a resulting magnetic field which acts on the workpiece, said partial coils being formed as spiral coils which are formed identically with respect to inductivity, electrical resistance, winding number and shape, and each of said partial coils extending on said coil carrier from an inner starting point in an identical form and with a corresponding identical distance to a neighboring one of said partial coils in a spiral-shaped manner outwardly.

2. A device as defined in claim 1, wherein each of said partial coils has at least two full windings each over correspondingly 360°.

3. A device as defined in claim 1, wherein said partial coils and said coil carrier are electrically separated from one another.

4. A device as defined in claim 1, wherein said partial coils are electrically connected with one another in a center of said coil carrier.

5. A device as defined in claim 1; and further comprising connections selected from the group consisting of inwardly located connections, outwardly located connections, and both, said connections being provided for "n" of said partial coils in said coil carrier so as to extend over a corresponding number of "n" sectors of a same size to be offset by same angular distances from one another.

6. A device as defined in claim 1, wherein said partial coils have windings and are arranged with said windings at identical distances on said coil carrier tightly near one another.

7. A device as defined in claim 1, wherein said partial coils have windings which are arranged with different distances from one another.

8. A device as defined in claim 1, wherein said partial coils have windings which are arranged near one another with changing distances selected from the group consisting of increasing distances and reducing distances.

9. A device as defined in claim 1, wherein said inner starting points of said partial coils and outwardly located connecting points of said partial coils are located on imaginary connecting lines which extend as rays at identical distances from a center of said coil carrier.

10. A device as defined in claim 1, wherein all said partial coils are connected with said at least one surge current generator which is a single current generator.

11. A device as defined in claim 1, wherein said partial coils are connected each with an individual current supply, such that said current supplies are programmable individually with respect to a voltage and a time of ignition.

12. A device as defined in claim 1, wherein said partial coils on said coil carrier are formed as flat coils with a rectangular conductor cross-section.

13. A device as defined in claim 1, wherein said partial coils are formed as coils which are cut from a single metal sheet blank.

14. A device as defined in claim 1, wherein said partial coils on said coil carrier are provided with a profile selected from the group consisting of a conical profile and a funnel-shaped profile.

15. A device as defined in claim 1, wherein said deformation tool has a matrix arranged in a matrix receptacle, said matrix in said matrix receptacle located opposite to an arrangement of said coils being surrounded by ventilating chambers in which air enclosed during a forming process between the workpiece and said matrix hollow chamber can escape.

16. A device as defined in claim 1, wherein said deformation tool has a matrix arranged in a matrix receptacle, said matrix on an outer periphery and on further locations where in the workpiece hole-shaped punches or openings must be produced, is formed so as to provide a separating action.

17. A device as defined in claim 16, wherein said matrix on said outer periphery and said further points for the separating action is provided with a design selected from the group consisting of a sharp-edged separating tool, inner cutting edges, inner deformation edges, corrugation and webs.

18. A method of electromagnetic high energy pulse deformation of workpieces of an electrically conductive material, comprising the steps of providing a deformation tool including a coil carrier and at least two partial coils arranged on said coil carrier; connecting said partial coils with at least one surge current generator so that magnetic fields of said individual partial coils superpose to produce a resulting magnetic field acting on the workpiece; forming said partial coils as spiral coils identically with respect to inductivity, electrical resistance, binding number and shape; extending each of said partial coils on said coil carrier from an inner starting point in an identical form and with an identical distance to a neighboring one of said partial coils in a spiral-shaped way outwardly.

19. A method as defined in claim 18; and further comprising acting synchronously on said partial coils so that current maxima of said partial coils are set simultaneously.

20. A method as defined in claim 18; and further comprising acting on said partial coils with said at least one surge current generator which is formed as a common surge current generator.

21. A method as defined in claim 18; and further comprising acting on said partial coils with individual current supplies which are programmable individually with respect to a voltage and a time of ignition.

22. A method as defined in claim 21; and further comprising during a deformation of the workpiece, providing an electronic control of said surge current generators with an increasing energy discharge so as to produce first a lower and then a higher pressure, so that during a deformation process air which is enclosed between the workpiece and the matrix hollow space can discharge and subsequently the workpiece assumes a design of the matrix.

23. A method as defined in claim 18; and further comprising during a fast deformation, guiding air which is enclosed between the workpiece and the matrix hollow space by a controlled radially outwardly oriented force application of the magnetic field, toward an outer edge of the matrix.

24. A method as defined in claim 18; and further comprising providing a vacuum in a hollow space of the matrix before the forming of the workpiece.

25. A method as defined in claim 18; and further comprising clamping the workpiece at its outer periphery between the coil carrier and the matrix receptacle or a pressing element in a functional plane of the coils at an axial distance from the matrix, so that during a forming process under the action of the magnetic field first it is hurled against an outer periphery of the matrix and subsequently deformed in a form hollow space of the matrix.

26. A method as defined in claim 25; and further comprising separating parts of the workpiece during striking on the matrix or forming in the form hollow space of the matrix, by sharp-edged edge regions on an outer periphery or in an inwardly located region of the form hollow space, so that after a forming process a desired finished product can be discharged from the deformation tool.

* * * * *